US005265753A

United States Patent [19]

Moorman

[11] Patent Number: 5,265,753

[45] Date of Patent: Nov. 30, 1993

[54] CONTAINER FOR FLEXIBLE BAG

[75] Inventor: Stephen E. Moorman, Maumee, Ohio

[73] Assignee: Georgia-Pacific Corporation, Atlanta, Ga.

[21] Appl. No.: 968,685

[22] Filed: Oct. 30, 1992

[51] Int. Cl.[5] ..... B65D 5/56; B65D 5/74

[52] U.S. Cl. ..... 220/465; 220/462; 222/540

[58] Field of Search ..... 220/403, 404, 408, 410, 220/416, 418, 462, 465; 222/173, 180, 183, 540, 555, 562, 563

[56] References Cited

U.S. PATENT DOCUMENTS

| | | | |
|---|---|---|---|
| 2,454,919 | 11/1948 | Hagan | 220/465 |
| 2,946,494 | 7/1960 | Kuss . | |
| 3,100,587 | 8/1963 | Cox, Jr. . | |
| 3,173,579 | 3/1965 | Curie et al. | 220/465 |
| 3,206,094 | 9/1965 | Humphrey et al. | 220/462 |
| 3,226,002 | 12/1965 | Walker | 222/183 |
| 3,233,817 | 2/1966 | Casady | 220/465 |
| 3,253,764 | 5/1966 | Goetschius et al. . | |
| 3,266,707 | 8/1966 | Aust et al. | 220/465 |
| 3,349,986 | 10/1967 | Chapman et al. . | |
| 3,363,807 | 1/1968 | Powell | 222/183 |
| 4,815,631 | 3/1989 | Eeg et al. . | |
| 5,054,644 | 10/1991 | Greenslade . | |
| 5,106,015 | 4/1992 | Vlasaty et al. | 222/540 |
| 5,176,313 | 1/1993 | Curry et al. | 220/465 |

FOREIGN PATENT DOCUMENTS

| | | |
|---|---|---|
| 922960 | 4/1963 | United Kingdom . |

*Primary Examiner*—Gary E. Elkins

*Attorney, Agent, or Firm*—Banner, Birch, McKie & Beckett

[57] ABSTRACT

A box for a flexible bag liner is formed from a blank of sheet material such as corrugated paperboard. The primary feature of the box is a retaining and locking structure for a spout of the bag liner disposed on an inner top flap. The inner top flap is attached to an inner portion of a side wall, and retains the spout in an aperture in either a retracted position or a dispensing position. The aperture secures the spout rigidly to facilitate filling and dispensing. An outer top flap covers the spout both during shipping and storage between uses.

30 Claims, 4 Drawing Sheets

CONTAINER FOR FLEXIBLE BAG

BACKGROUND OF THE INVENTION

Bag-in-box containers are used in a variety of industries for shipping, storing and dipensing materials. Such containers are useful because they provide a protective outer box, constructed from corrugated paperboard and the like, which withstands handling during shipping and use. Protectively enclosed within the box is a flexible liner or bag which usually has an opening, such as a spout, for filling and dispensing any pourable material. The spout is typically disposed within the box during shipping and can be exposed by opening the box, often by means of a removable punch-out in a wall of the box.

Although the box can be constructed in any size and shape, the box of the present invention is designed primarily as alternative packaging for the five gallon plastic pail. Environmental concerns such as overflowing landfills, hazardous material containment and disposal have made the plastic containers undesirable. Many landfills are refusing to accept five gallon plastic pails. Hence, there is great interest in alternative packaging to replace the plastic containers. However the alternative should provide the same containment, fill and ease of use features as the five gallon plastic pail without the disposal problems.

The following patents exemplify existing boxes for bag-in-box containers.

Cox, Jr., U.S. Pat. No. 3,100,587, discloses a bag-in-box construction wherein a spout of the bag is secured to a top flap of the box for movement between a retracted storage position within the box and a dispensing position wherein the spout extends from a corner of the box.

Chapman et al., U.S. Pat. No. 3,349,986, discloses (see FIGS. 7 and 8) a bag-in-box structure wherein an aperture for friction-locking the bag spout in a fixed position is provided on a top flap of the box. Adjacent top flaps, once opened by a tear-away, leave the spout in an exposed condition. A hand-hold slot is provided adjacent to the spout.

Kuss, U.S. Pat. No. 2,946,494, discloses a two box bag-in-box structure wherein a spout of the bag is fixedly secured in an aperture provided in the corner of a cover flap of an inner box. The spout, once mounted, is fixed on the inner box. The inner box is placed in an outer box having cover flaps which cover the spout for shipping.

Greenslade, U.S. Pat. No. 5,054,644, discloses a bag-in-box construction wherein a spout of the bag is secured in a centrally located aperture of a top flap of the box. The spout, once mounted for dispensing, is fixed in an exposed condition.

Eeg et al., U.S. Pat. No. 4,815,631, and Goetschius et al., U.S. Pat. No. 3,253,764, each disclose bag-in-box constructions wherein a spout of the bag is secured in an aperture provided in a lower corner portion of the box. The Eeg et al. aperture serves also as a hand-hold. In Goetschius et al., the spout extends through an enlarged aperture in an inner wall panel and is locked in a smaller aperture of an outer pivotable panel. With both constructions, the spout is exposed when mounted in the dispensing position.

British Patent No. 922,960, discloses a dispensing carton, without an inner plastic bag, wherein a dispensing spout is mountable in an aperture cut into overlapping adhesively attached wall panels of the box.

None of the above described patents discloses a box for use with a bag, constructed from a blank of sheet material, such as corrugated paperboard and the like, that is configured for efficient box plant manufacturing, provides the same containment, fill and ease of use features as the five gallon plastic pail, and serves as a recyclable alternative to plastic containers.

SUMMARY OF THE INVENTION

The primary object of the present invention is to provide an alternative to the five gallon plastic pail having the advantages over a plastic container of easy disposability, recyclability, efficient manufacture, and efficient space utilization, while at the same time providing a container which facilitates handling and having sufficient strength for a variety of applications.

It is another object of the invention to provide a container that is suitable for use in specific applications, such as in the printing ink industry where the five gallon plastic pail is the predominate package.

It is a further object of the invention to provide a container with features making it easy to open and reuse, while providing maximum protection to the bag and spout during shipping, handling and storage.

It is a still further object of the invention to provide a container with movable positioning of the spout for ease of use, including spout support features for locking the spout in place for initial filling, positive positioning of the spout in a dispensing position, and position retention of the spout for facilitating reuse.

It is another object of the invention to provide a container with relatively rigid spout support features for position retention of the spout during filling to adapt the container for collecting waste materials, especially hazardous waste.

It is a yet further object of the invention to provide a container with ease of dispensing features including placement of the spout in a corner of the box coupled with hand-hold features in the walls to facilitate handling and avoid contamination of materials on the box.

It is an additional object of the invention to provide a container for efficient manufacturing, shipping and storage, including ease of scrap material removal, enhanced glue joint alignment allowing the box to be squared up, and 100% utilization of space on a standard pallet.

These and other objects are achieved in accordance with a first aspect of the invention by a box with five side wall panels instead of the normal four and a glue tab. The fifth panel underlies a side wall of the box, and functions both as a glue tab and an attachment panel for an inner minor top flap. The inner minor top flap underlies the top closure flap associated with the side wall of the box, and provides the box with a spout support means.

In another aspect, the invention provides a spout support means on an inner minor top flap which enables the spout to be retracted into the box between uses, and to be extended into a dispensing position. The spout support means cooperates with the overlying top closure flap to lock the spout in a rigid position for filling or dispensing. Parallel fold lines between the inner minor top flap and the attachment panel enable the spout to be in either an extended position or a retracted position.

In a further aspect, the invention provides a covering means for the spout when the spout is retracted or tucked into the box. An overlying top closure flap covers the spout and provides maximum protection for the spout both during shipping and storage between uses.

Other objects and features of the invention will become apparent and fully understood from the following detailed description of the preferred embodiment, taken in connection with the drawing figures.

DETAILED DESCRIPTION OF THE PREFERRED EMBODIMENTS

Figure 1:
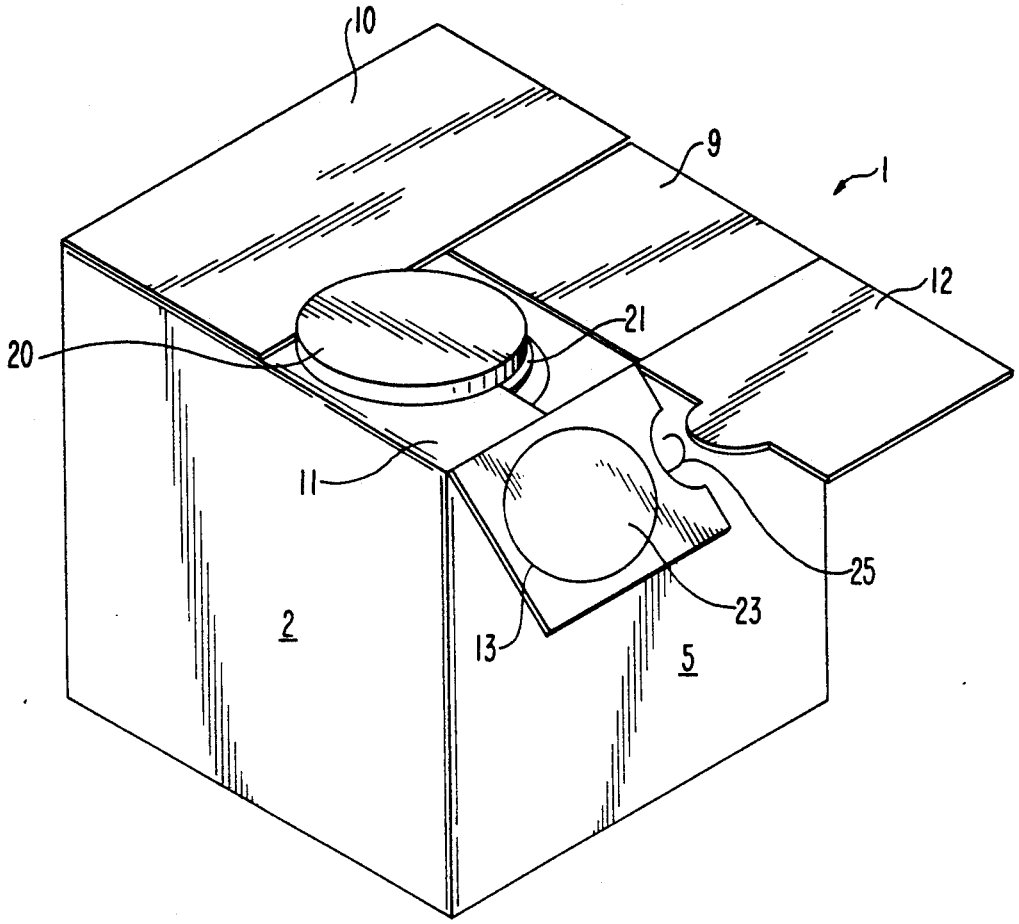
FIG. 1 is a perspective view of an assembled box in accordance with the preferred embodiment of the present invention, shown with the top in a partially open condition.
Figure 2:
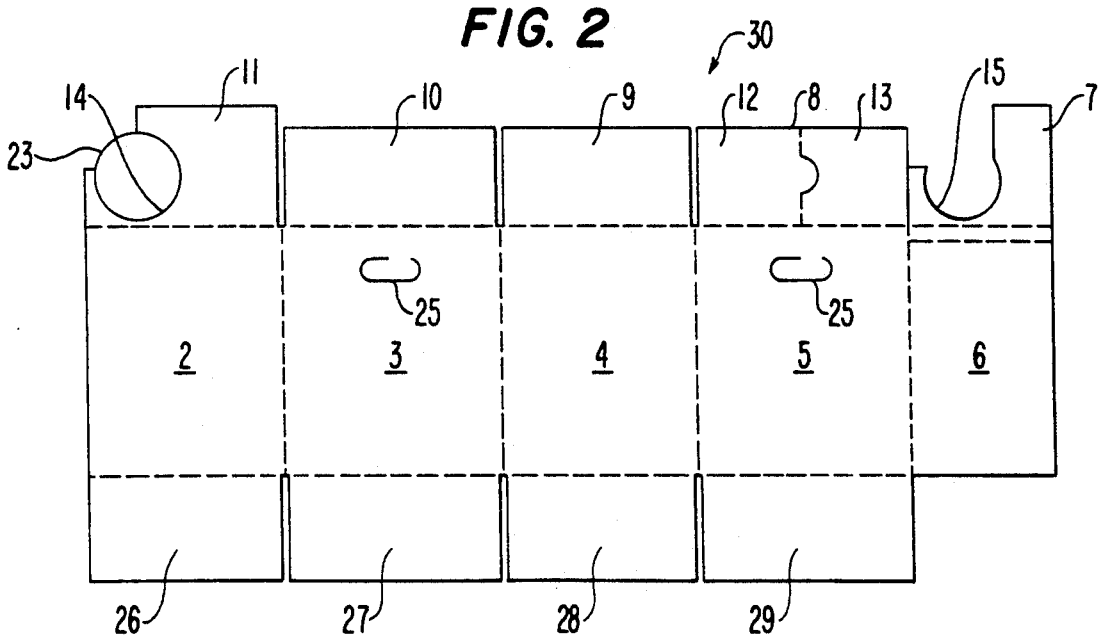
FIG. 2 is a plan view of a box blank used to form a box in accordance with the preferred embodiment of the present invention.
Figure 3:
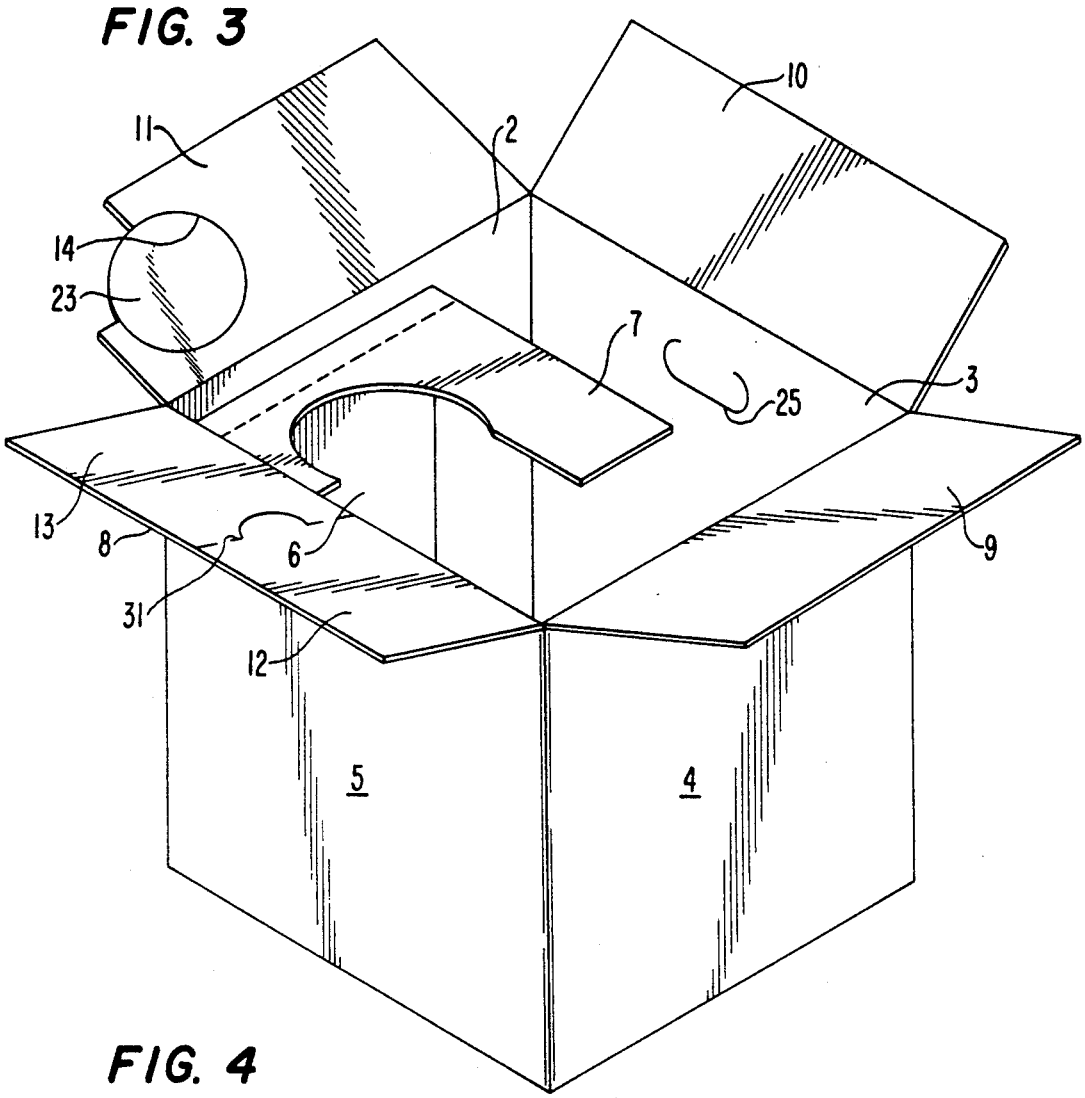
FIG. 3 is a perspective view of the assembled box of FIG. 1, shown in a fully open condition.

Referring to FIGS. 1-3, illustrated is an assembled box or container 1 of the present invention formed from a blank 30. The blank is preferably formed of conventional corrugated container board such as corrugated paperboard. Corrugated paperboard is generally preferred for its relatively low cost, high strength, disposability and recyclability.

Figure 6:
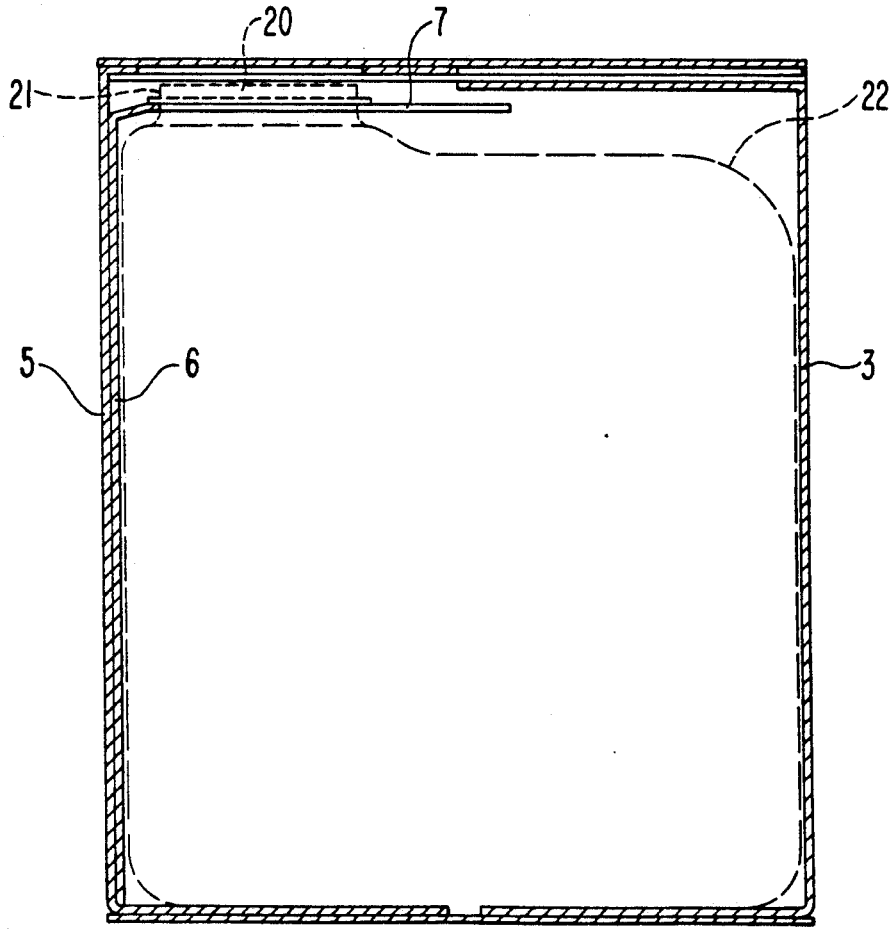
FIG. 6 is a cross sectional view of the assembled box taken along line 6—6 of FIG. 5.
Figure 7:
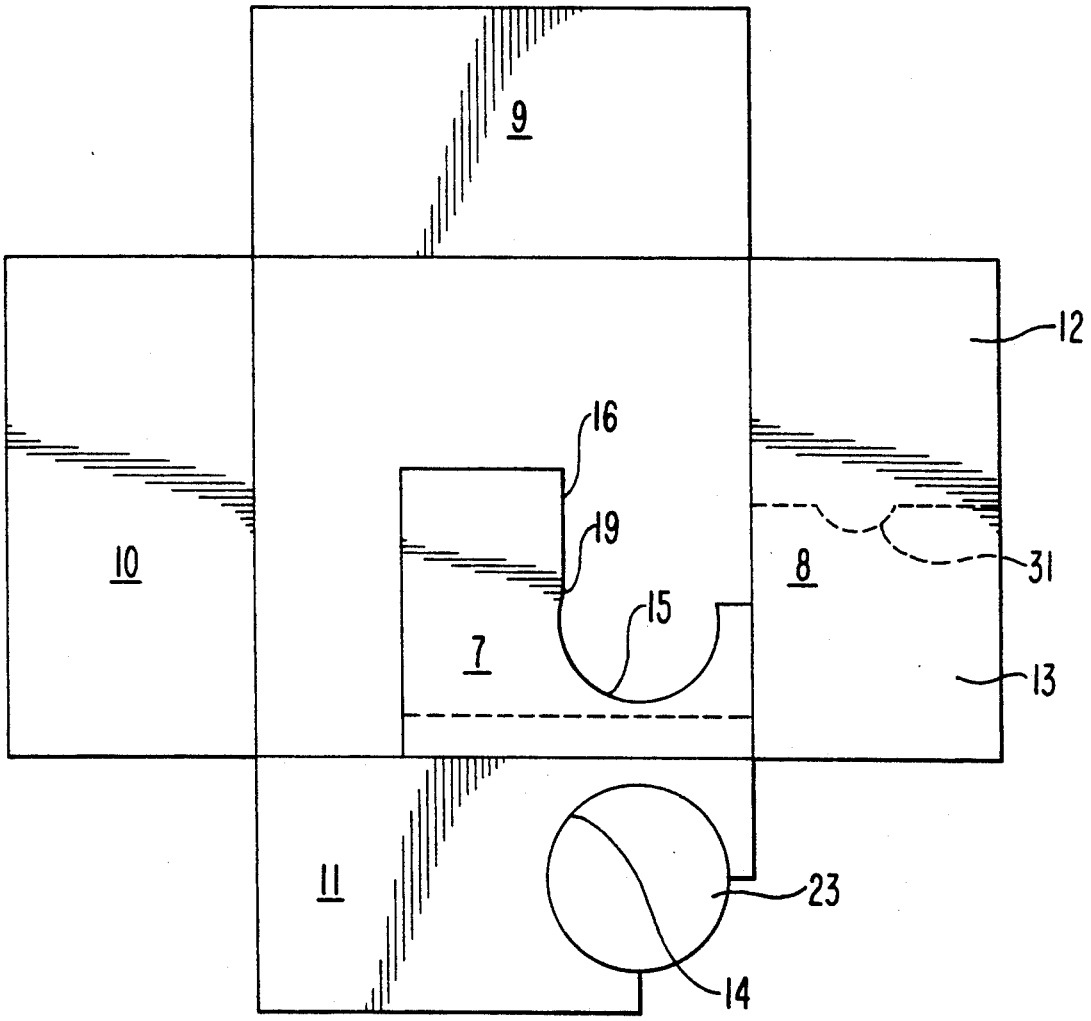
FIG. 7 is a top plan view of the assembled box shown in a fully open condition of FIG. 3.

Assembled box 1 comprises side walls made from panels 2-6, one wall having an exterior panel 5 and an interior panel 6. FIG. 6 illustrates how the exterior panel 5 and interior panel 6 are positioned in the assembled box. The interior panel 6 serves as both an attachment panel for an inner minor top flap 7, and a glue panel. Box 1 also comprises bottom closure flaps 26-29 which form a bottom closure structure. The box 1 also includes top flaps 8-11, and the interior panel 6 has inner minor top flap 7. The inner minor top flap 7 includes an aperture 15 into which the spout 20 is inserted and retained. The top flap 11 also has an aperture 14 into which the spout 20 is inserted when in the extended dispensing position. FIG. 1 illustrates the extended dispensing position in which the top flap 11 is flush with the top of the box 1, and the spout 20 extends above the box top. When the spout 20 is inserted into the aperture 14, the outer peripheral wall of the spout 21 is engaged on both apertures 14 and 15, and the spout 20 is held rigidly in the position shown in FIG. 1. Although the position shown in FIG. 1 is called the extended dispensing position herein and in the claims, obviously the rigidity provided by that position is also advantageous when filling the flexible bag 22 through the spout 20.

Figure 4:
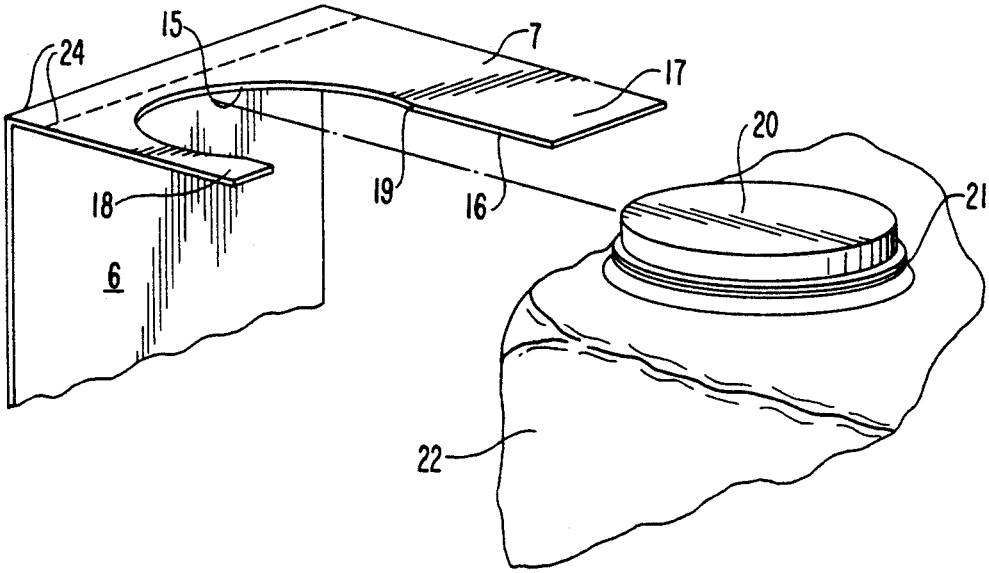
FIG. 4 is an exploded perspective view of the inner top flap, aperture and spout of the box in accordance with the preferred embodiment of the present invention.

Referring to FIG. 4, illustrated is a perspective view of the inner minor top flap 7 and spout 20. The inner top flap 7 has an aperture 15 which is a portion of a substantially circular cut-out. The inner top flap 7 includes legs 17 and 18 disposed on the sides of the aperture 15. The rim of the aperture 15 matingly receives the outer peripheral wall 21 of the spout 20. The wall 21 of the spout 20 is guided along the guiding edge 16 until the spout 20 is inserted into the aperture 15. Angle 19 retains the spout 20 within the aperture 15 defined by legs 17 and 18, and prevents the spout from exiting the aperture 15.

The inner top flap 7 is connected to the interior panel 6 by double fold lines 24. The double fold lines 24 allow the inner top flap 7 to move between a retracted position shown in FIG. 3, and the dispensing position shown in FIG. 1. As will become apparent, the distance between the double fold lines 24 can be varied according to the type and size of spout used with the box. A longer spout, for example, would require fold lines which are further apart to accommodate the size of the spout.

Figure 5:
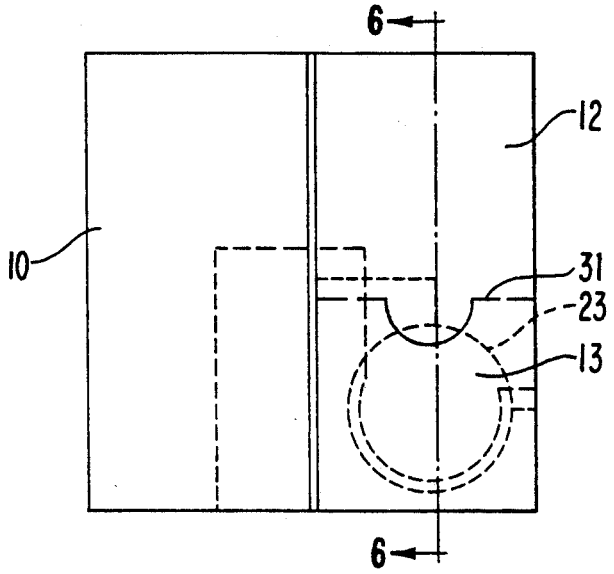
FIG. 5 is a top plan view of the assembled box of FIG. 3, shown in a closed condition.

During shipping, the spout 20 is disposed in the retracted position, making use of the lower of the two fold lines 24. The retracted spout is covered by the top closure flaps 8-11 to protect the spout 20 and flexible bag 22 during handling, as shown in FIGS. 5 and 6. The spout 20 can also be easily retracted into the box 1 between uses, and covered with the top closure flaps for efficient storage. Since the spout 20 can be retracted into the box 1 for storage, it is protected and allows for stacking of containers which have been opened and used.

During use, the spout 20 is disposed in the dispensing position as shown in FIG. 1. The dispensing position makes use of the upper of the fold lines 24 which makes inner top flap 7 flush with the top of the box 1. The spout 20 is simply grasped through the aperture 14 in the outer top flap and inserted into the aperture 14. The spout 20 will be rigidly retained in aperture 14 for pouring or filling.

The top of box 1 is sealed by inserting spout 20 into the inner top flap 7 aperture 15, and pushing into the retracted position as shown in FIG. 3. Top flaps 9 and 11 are folded down. Top flap 11 has a removable piece 23 which when torn off will form the aperture 14. Top flap 10 is folded down next to last, and last to be folded down is top flap 8. The box 1 can be sealed since top flaps 8 and 10 are disposed across the top of the box in a flush relationship.

Top flap 8 has a section 12 and a tear-away section 13. Sections 12 and 13 are separated by a perforated line 31. Section 13 is adhesively attached to the removable piece 23 of top flap 11, so that when the box is opened by tearing away section 13, the removable piece 23 is also torn away providing aperture 14 in flap 11. In other words, when the box is opened, section 13 may be left attached as shown in FIG. 1 or may be completely torn away as described.

To dispense from or fill the bag, the box 1 is opened by tearing away section 13 of top flap 8 which automatically forms aperture 14. The spout 20 which is retained on aperture 15, is grasped through aperture 14 and the outer peripheral wall 21 of the spout 20 is engaged on the rim of aperture 14 in the extended or dispensing position. Since the spout 20 is retained on two flap apertures 14 and 15, the construction of the present invention provides rigidity to the spout in the extended position.

The spout 20 is preferably located at a corner of the box top so as to facilitate pouring. Slots 25 are positioned in the side walls so the box 1 can be held to pour or fill the bag 22 through the spout 20. The slots 25 are preferably in the side walls or panels 3 and 5, perpendicular to the side wall comprising interior panel 6 and exterior panel 5.

If the box 1 and bag 22 need to be reused, the spout 20 is disengaged from the aperture 14 and pushed down into the box 1 into the retracted position using the lower of the double fold lines 24. When the spout 20 is in the retracted position, the aperture 14 overlies the spout 20 and is offset enough to prevent the spout 20 from extending out of aperture 14, as shown in FIG. 5. Only if the spout 20 is positively moved and engaged onto aperture 14 can it be in the extended position. The retracted position feature of the spout between uses allows the box to be stacked in storage since the spout is protected inside the box, and nothing protrudes out of the box.

The invention has been described in terms of a presently preferred embodiment thereof. Other embodiments and modifications within the scope and spirit of the invention will occur to those having ordinary skill in the art.

I claim:

1. A container comprising:

a plurality of side walls defining a polygonal shape;

a bottom closure structure for closing the bottom of said container;

one of said side walls having an inner top flap and an outer top flap forming a portion of a top structure, said top structure comprising a support means for supporting a spout of a flexible bag; and a positioning means to position the spout in either a dispensing position or a tucked storage position.

2. A container as in claim 1, wherein said support means is an aperture defining an aperture rim on said inner top flap.

3. A container as in claim 2, wherein said inner top flap aperture is a portion of a substantially circular cutout.

4. A container as in claim 2 wherein said aperture rim of said inner top flap aperture corresponds to an outer peripheral wall of the spout.

5. A container as in claim 4, wherein said outer top flap includes an aperture to align with said inner top flap aperture such that said outer top flap secures the spout when the spout is in said dispensing position.

6. A container as in claim 5, wherein a portion of said outer top flap covers a portion of the spout when the spout is in said tucked storage position.

7. A container as in claim 5, wherein said outer top flap aperture is formed by a removable piece from said outer top flap.

8. A container as in claim 7, further comprising a tear-off piece on another top flap, said tear-off piece is adhesively attached to said removable piece on said outer top flap, wherein when said tear-off piece is removed said removable piece is also removed.

9. A container as in claim 4, wherein said rim of said inner top flap aperture is adapted to engage and retain at least a portion of the outer peripheral wall of the spout.

10. A container as in claim 9, wherein said inner top flap further comprises a guiding means for guiding the spout into said inner top flap aperture.

11. A container as in claim 10, wherein said guiding means comprises a guiding edge on said inner top flap leading to said rim of said aperture.

12. A container as in claim 11, said support means further comprising a locking means for locking the spout in said inner top flap aperture, said locking means comprising a first leg and a second leg with said inner top flap aperture therebetween, said guiding edge being along a portion of said first leg, and wherein said first leg and said second leg are adapted to prevent the spout from exiting said inner top flap aperture.

13. A container comprising:

a plurality of side walls defining a polygonal shape, each of said side walls having a top closure flap and a bottom flap;

one of said side walls having an exterior panel and an interior panel, wherein said top closure flap of said one side wall is hingedly connected to said exterior panel, said interior panel of said one side wall having an inner minor top flap hingedly connected to said interior panel, said inner minor top flap having a support means to support a spout of a flexible bag; and a positioning means to position the spout in either a dispensing position or a tucked storage position.

14. A container as in claim 13, wherein said positioning means comprises parallel hinge lines between said interior panel and said inner minor top flap.

15. A container as in claim 13, wherein said support means is an aperture defining an aperture rim on said inner minor top flap.

16. A container as in claim 15, wherein said inner top flap aperture is a portion of a substantially circular cutout.

17. A container as in claim 15, wherein said exterior panel top closure flap includes an aperture to align with said inner minor top flap aperture such that said exterior panel top closure flap secures the spout when the spout is in said dispensing position.

18. A container as in claim 17, wherein a portion of said exterior panel top closure flap covers at least a portion of the spout when the spout is in said tucked storage position.

19. A container as in claim 17, wherein said exterior panel top closure flap aperture is formed by a removable piece from said exterior panel top closure flap.

20. A container as in claim 19, wherein a portion of one of said top closure flaps forms a tear-off piece, said tear-off piece is adhesively attached to said removable piece on said exterior panel top flap, wherein when tear-off piece is removed said removable piece is also removed.

21. A container as in claim 15, wherein said rim of said inner minor top flap aperture corresponds to an outer peripheral wall of the spout.

22. A container as in claim 17, wherein said rim of said inner minor top flap aperture is adapted to engage and retain an outer peripheral wall of the spout.

23. A container as in claim 15, wherein said inner minor top flap further comprises a guiding means for guiding the spout into said inner minor top flap aperture.

24. A container as in claim 23, wherein said guiding means comprises a guiding edge on said inner minor top flap leading to said rim aperture.

25. A container as in claim 24, said support means further comprising a locking means for locking the spout in said inner top flap aperture, said locking means comprising a first leg and a second leg with said inner top flap aperture therebetween, said guiding edge being along a portion of said first leg, and wherein said first leg and said second leg are adapted to prevent the spout from exiting said inner top flap aperture.

26. A container as in claim 13, wherein at least a portion of said interior panel is attached to a portion of said exterior panel.

27. A container as in claim 26, wherein attachment of said portion of said interior panel to said portion of said exterior panel is achieved by an adhesive.

28. A container as in claim 13, further comprising openings on opposite ones of any of said side walls to facilitate dispensing and handling.

29. A container as in claim 13, wherein said support means for supporting the spout is located at a corner of said box to facilitate dispensing.

30. A container as in claim 13, wherein said top closure flaps and bottom flaps are hingedly connected to said side walls by hinge lines.

* * * * *